US006170285B1

(12) United States Patent
Huffman et al.

(10) Patent No.: US 6,170,285 B1
(45) Date of Patent: Jan. 9, 2001

(54) VENDING MACHINE

(75) Inventors: John P. Huffman, Fenton; Charles W. Percy, Chesterfield; Mark R. Henning, St. Charles; Gregory Scott Ivey, O'Fallon; Ronald P. Petersen, Arnold, all of MO (US)

(73) Assignee: Crane Co., Stamford, CT (US)

( * ) Notice: Under 35 U.S.C. 154(b), the term of this patent shall be extended for 0 days.

(21) Appl. No.: 09/427,240

(22) Filed: Oct. 26, 1999

(51) Int. Cl.[7] ..... F25D 19/02

(52) U.S. Cl. ..... 62/448; 62/449; 62/450; 221/150 R

(58) Field of Search ..... 62/448, 449, 450; 221/150 HC, 150 R

(56) References Cited

U.S. PATENT DOCUMENTS 4,019,339 * 4/1977 Anderson ..... 62/449 X
4,326,620 * 4/1982 Felix et al. ..... 221/3
4,509,339 * 4/1985 Mehlan et al. ..... 62/450
4,730,750 3/1988 Ficken ..... 221/124
4,815,302 * 3/1989 Aoki et al. ..... 221/150 HC X
4,977,754 * 12/1990 Upton et al. ..... 221/150 R X
5,199,273 * 4/1993 Silva et al. ..... 62/450 X
5,417,081 * 5/1995 Rudick et al. ..... 62/448 X
5,678,421 * 10/1997 Maynard et al. ..... 62/448 X
5,875,645 3/1999 Dunnigan ..... 62/407
5,971,205 * 10/1999 Michaels et al. ..... 221/150 A X

* cited by examiner

*Primary Examiner*—William Doerrler
*Assistant Examiner*—Chen-Wen Jiang
(74) *Attorney, Agent, or Firm*—Senniger, Powers, Leavitt & Roedel

(57) ABSTRACT

A vending machine having a self-contained self-aligning refrigeration unit, a temperature sensing probe positioned in front of the machine behind a glass panel for sensing the temperatures in the machine near the product to be vended and having a monetary unit which slides in and out of the cabinet and rotates for easy access.

13 Claims, 10 Drawing Sheets

10
14
106
108
16
12
24

32
54
34
42
50
46
52
77
48
56
40
50
58
58

12
74
64
72
70
66
62
68
32
76
60
42

12
74
64
62
66
76
60
32

102
126
106
108
104
114
112
116
118

120
82
126
22
128
114
116
118
124

VENDING MACHINE

FIELD OF THE INVENTION

The present invention relates to vending machines and, more particularly, to vending machines which vend many different types of products and are configured to dispense a desired product to a customer upon insertion in the machine of adequate currency.

BACKGROUND OF THE INVENTION

Many vending machines have refrigerated portions from which refrigerated or frozen foods can be vended. The basic refrigeration system consists of an evaporator and fan, compressor and condenser. There are many different system configurations currently in use for providing the necessary cooling. Some are permanently installed in the vending machine while others are designed to be removable for greater ease of servicing. Since spoilage of refrigerated or frozen items can occur quickly on failure of the refrigeration system it is essential to have the shortest down time possible to preserve the product. It is common with removable refrigeration systems to merely take a new system to the vending machine site and replace the defective unit and take the defective unit for repair. This tends to provide the shortest down time, but the amount of time necessary to make the substitution will, again, depend on the manner in which the system is configured and the difficulty of removal of the old system and installation of the new. Some such systems require partial disassembly of the vending machine to remove the system which prolongs the down time and enhances the possibility of spoilage of the items in the machine. A better approach used in prior art vending machines is a system which can be slid in and out of the vending machine and tends to self align the interconnecting duct work which is needed to introduce the cooled air into the refrigerated portion of the vending machine and to remove the spent warmed are therefrom. Such a machine is disclosed, for example, in U.S. Pat. No. 4,730,750, assigned to the same assignee as the present invention. In that machine there is provided a self-contained refrigeration unit which has duct work which engages mating duct work in the refrigerated portion of the vending machine such that when the refrigeration unit is slid into the bottom of the vending machine the ducts are aligned and, when engaged, seal between the two duct works. Alignment tracks on the floor of the vending machine help align the duct work from right to left. However, this system can be difficult to align from front to back so as to completely seal between the two duct works.

Another difficulty with prior art vending machines is in the area of the monetary unit where the customer inserts his or her money to make a purchase. Because there is limited space within the housing of a vending machine there are difficulties in mounting and servicing various components of the monetary system such as the bill validator, coin changer and microprocessors which control various functions of the vending machine. Security in this area is also a problem since the monitory system is a usual area for vandals to attempt to gain entry or "jackpot" the mechanisms.

A still further problem associated with some prior art vending machines, particularly those intended for outdoor use, is their inability to satisfactorily control the internal temperature of the machine within the food storage area. This is true whether the machine is vending refrigerated or frozen foods. One main reason for this is the use of a large glass front on the machines which causes substantial heat transfer, particularly from the sun, although in cold weather the transfer can be in the opposite direction from the inside to the outside of the food storage area.

SUMMARY OF THE INVENTION

The present invention overcomes the above-described difficulties and disadvantages of prior art vending machines by providing a vending machine that has a self-aligning self-contained refrigeration and heating unit which can be easily and quickly placed in or taken out of the machine, by providing a vending machine with a monetary system that is compact and easy to install and service, and by providing a vending machine with a temperature control system that keeps the food in the front of the machine, adjacent the glass front, at substantially the desired temperature.

The above advantages are achieved by providing a vending machine comprising a housing having a floor and forming an interior space with an open front; a door attached to the housing for pivotal movement between an open position for allowing access to the interior space of the housing through the open front and a closed position for covering the open front; a horizontal shelf in the housing dividing the interior space of the housing into upper and lower portions, the shelf defining an opening along an edge thereof extending towards the open front of the housing; and a refrigeration unit having substantially vertical side portions engageable with the edge of the shelf defining the opening therein, the refrigeration unit being slidable on the floor of the housing into the housing with the front door in the open position such that the vertical side portions engage the edge of the shelf along substantially the length of the opening therein. Further advantages are obtained by providing such a vending machine wherein the edge of the shelf defining the opening has tapered converging sides and the sides of the refrigeration unit are similarly tapered. Still further advantages are obtained by providing such a vending machine which includes the refrigeration unit having an evaporator and fan located in the upper portion of the housing and a compressor and condenser located in the lower portion of the housing when the unit is engaged with the shelf. Yet further advantages are provided by including a heating member in the refrigeration unit disposed in the upper portion of the housing when the unit is engaged with the shelf. Further advantages are obtained by providing such a machine wherein the shelf and upper portion of the housing are insulated. Additional advantages are obtained by providing such a machine wherein the edge of the shelf defining the opening is provided with a seal engageable with the side portions of the refrigeration unit. Yet further advantages are obtained by providing such a machine including an output duct in the refrigeration unit adjacent the fan; a circulation duct along an inside wall of the housing connectable with the output duct for receiving cold air therefrom and circulating it through the housing; and a return air passage formed in the refrigeration unit adjacent the evaporator for returning air circulated through the housing to the evaporator to be cooled.

The present invention provides advantages over the prior art by providing a method of removably sealing a refrigeration unit in a vending machine having an interior space accessible through an open front covered by a door, comprising the steps of providing a horizontal shelf with a contoured edge facing the open front in the interior space of the vending machine so as to divide the interior space into upper and lower portions; providing a refrigeration unit with vertical side walls engageable with the contoured edge of the horizontal shelf; and sliding the refrigeration unit into the interior space of the vending machine so that the vertical side walls of the refrigeration unit engage the contoured edge of the shelf. Further advantages are obtained by providing such a method including the steps of providing the contoured edge with converging side walls and providing the side walls of the refrigeration unit to matingly engage the converging side walls of the contoured edge of the shelf when the unit is slid into the housing.

Other advantages over prior art vending machines are obtained by providing a vending machine which includes a housing forming an insulated interior portion and a glass front door; a plurality of product support shelves contained in the interior portion of the housing; a temperature sensing probe disposed on the interior portion adjacent the shelves and the glass in the door; a combined refrigeration and heating unit disposed in the housing; and a controller associated with the unit and the temperature sensing probe so as to receive temperature information from the probe and operate the unit to either heat or cool the interior portion of the housing. Further advantages are obtained by providing such a machine wherein the temperature sensing probe is disposed in the lower front portion of the machine.

Still further advantages over prior art vending machines are obtained by providing a vending machine comprising a housing having vertical side walls and forming an interior space with an open front; a door attached to the housing for pivotal movement between an open position for allowing access to the interior space of the housing through the open front and a closed position for covering the open front; a slide-out frame mounted for movement into and out of the cabinet; a monetary unit, including a message screen, mounted to the frame for movement into and out of the cabinet and adapted for interaction with a customer; a monetary unit programming control panel mounted to the frame for movement therewith into and out of the housing and being interconnected to the message screen for showing programming action on the message screen; the monetary unit and control panel being mounted to the frame for pivotal movement from a position for storage in the housing to a position where the monetary unit and control panel can be accessed for servicing. Further advantages are obtained by such a machine wherein the monetary unit includes a bill validator mechanism having a paper currency storage box, the bill validator mechanism being mounted for pivotal movement on the frame such that it can be pivoted from a storage position wherein the currency storage box is adjacent a solid panel of the frame so as to prevent unauthorized access thereto to a servicing position wherein the currency storage box is away from the frame such that the currency storage box can be accessed.

BRIEF DESCRIPTION OF THE DRAWINGS

Corresponding reference characters indicate corresponding parts throughout the drawings.

DETAILED DESCRIPTION OF PREFERRED EMBODIMENTS

Figure 1:
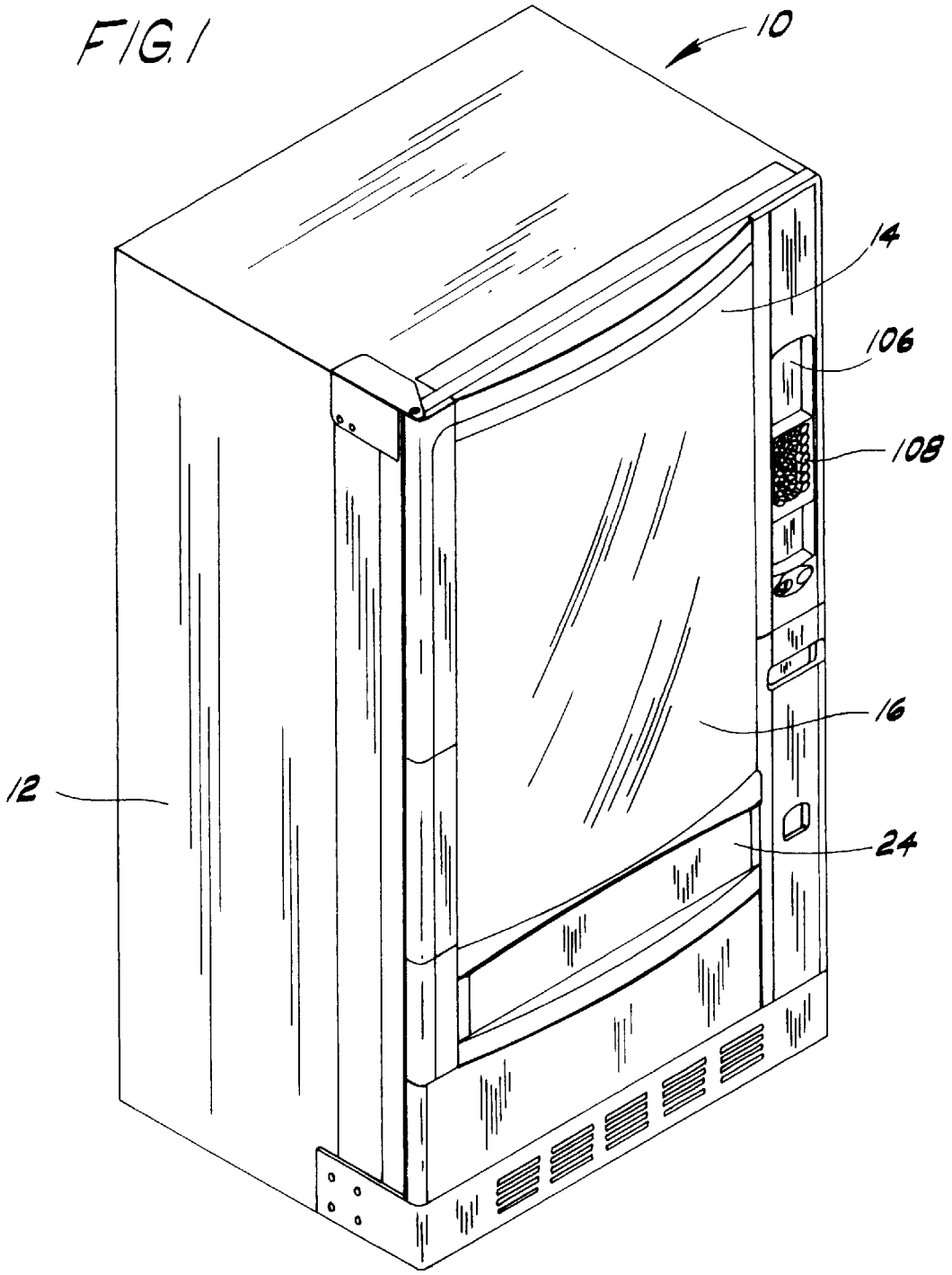
FIG. 1 is a perspective view of the preferred embodiment of the present invention.
Figure 2:
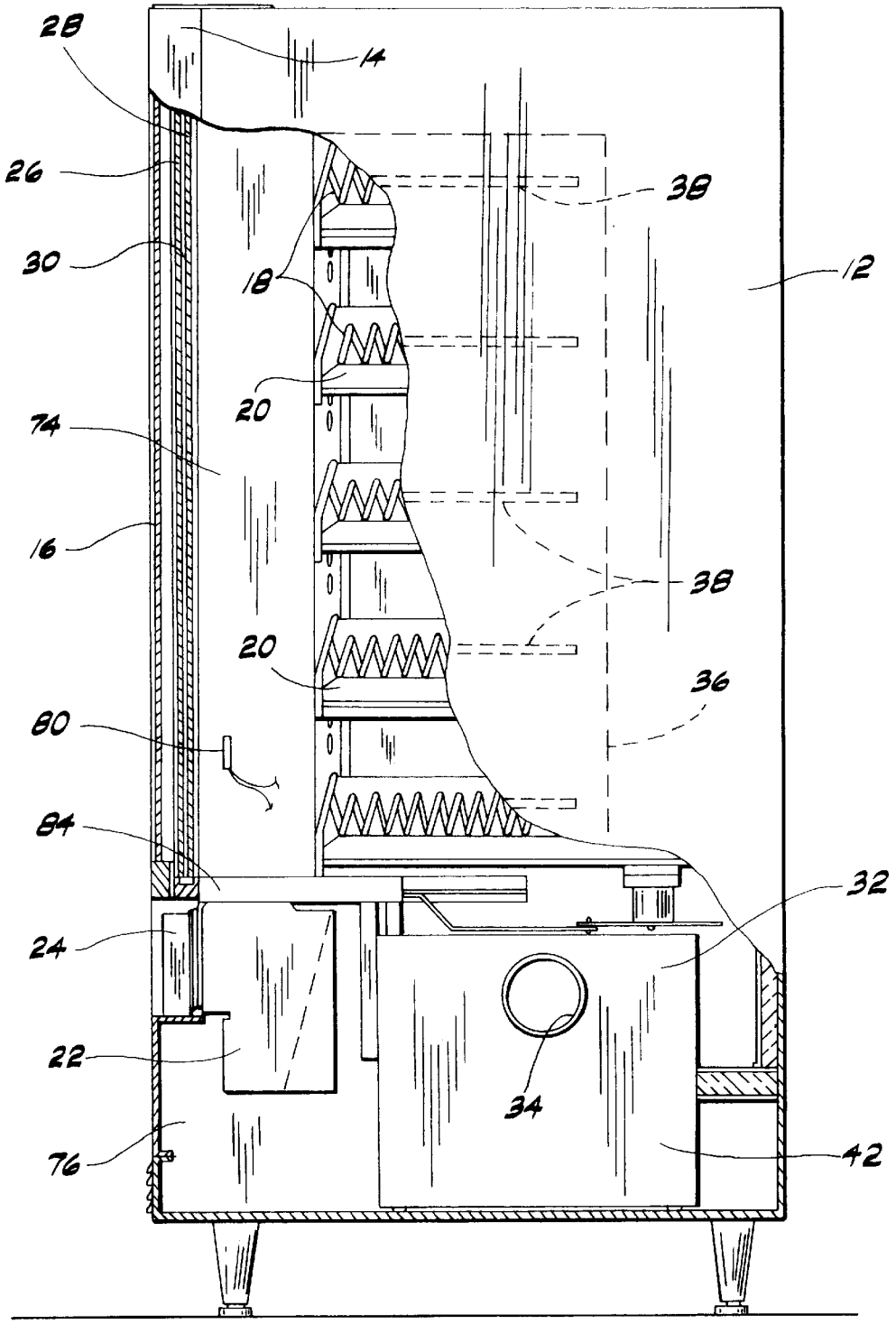
FIG. 2 is a side elevational view partially cutaway of the preferred embodiment.

In the preferred embodiment illustrated in the drawings the vending machine 10 includes a cabinet 12 closed by a front service door 14. Door 14 is provided with a glass front 16 to allow the customer to see the product contained in the machine for selection. Product is supported in the spirals 18 and supported by trays 20 in a well known manner for vending. A vend bucket 22, as best seen in FIG. 2, is disposed in the bottom of the vending machine 10 and mounted to the inside of the front door 14 for receiving product dispensed from the shelves 20. A vend bucket door 24 is mounted to the door 14 for pivotal movement to allow a customer to reach into the vend bucket to receive product that has been dispensed into it, but otherwise covers the entry to the vend bucket 22. In the preferred embodiment, a pair of glass panes 26 and 28 with a dead air or gas space 30 is provided for insulation while allowing the product on the shelves 20 to be visible to the customer.

Figure 3:
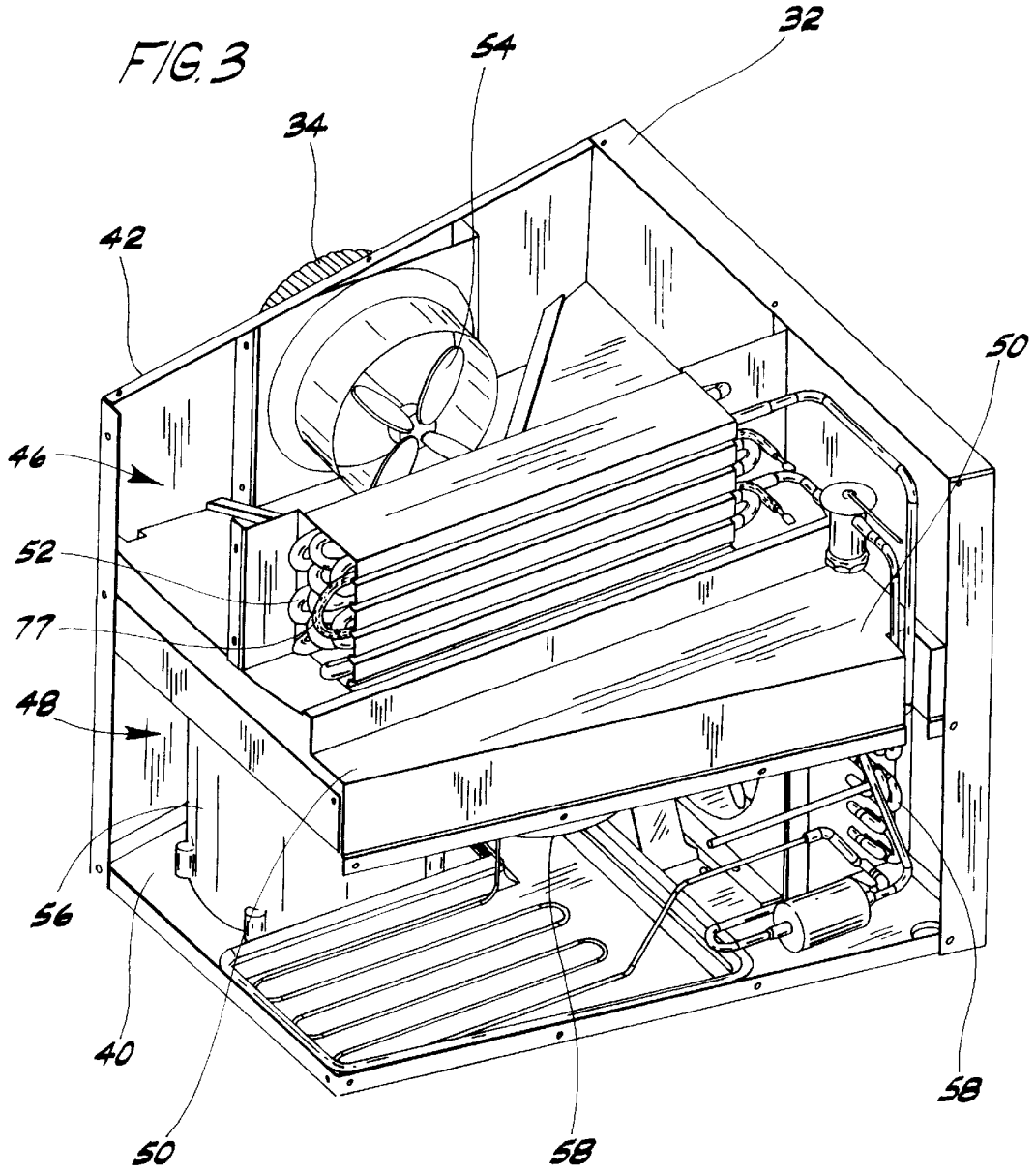
FIG. 3 is a perspective view of the refrigeration unit of the preferred embodiment with some outer panels removed for ease of viewing.
Figure 4:
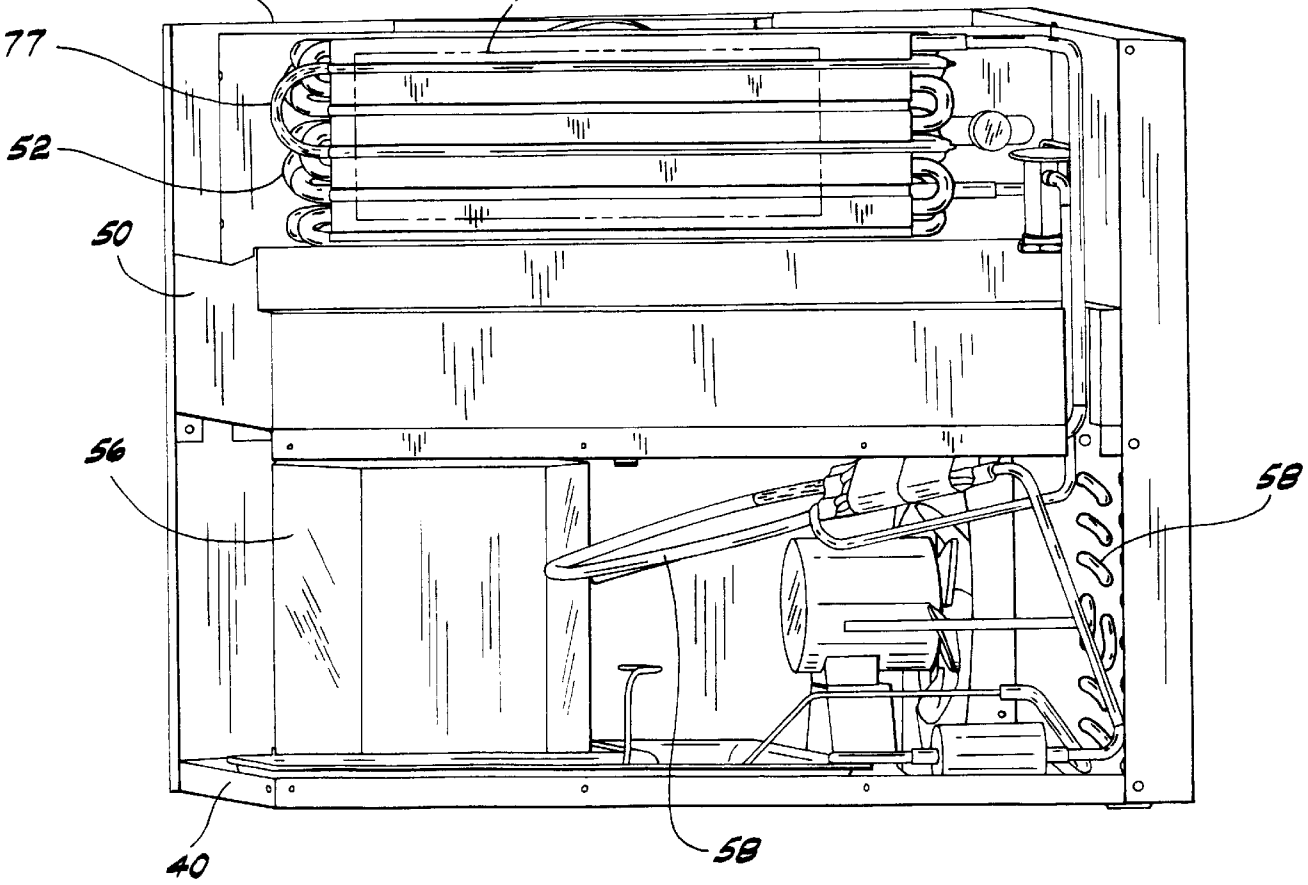
FIG. 4 is a side elevational view of the refrigeration unit of FIG. 3.

A refrigeration unit 32 is removably disposed in the bottom of the vending machine 10. It is provided with a cold air outlet duct 34 which, when the unit 32 is disposed in its operating position in the bottom of the cabinet 12, directs cold air into a vertical duct 36 on the inside of the cabinet 12 which distributes the cold air to locations adjacent the product shelves 20 where it passes through openings 38 to allow the cold air to flow over the product to maintain it at the desired temperature. As best seen in FIGS. 3 and 4, the refrigeration unit 32 has a sheet metal housing consisting of a floor panel 40, converging vertical side walls 42 and an opposite side removed to show the interior of the unit 32, and a rear vertical wall, also removed to more clearly show the interior of the unit 32. A warm air return air duct 44 in the otherwise removed vertical side wall is shown in phantom in FIG. 4. The unit 32 is also divided horizontally into upper and lower portions 46 and 48, respectively, by horizontal sheet metal plate 50. A series of evaporator coils 52 are mounted in the upper portion 46 adjacent evaporator fan 54 which draws cold air out of the coils 52 and into the duct 34 for distribution to the product shelves 20 as described above. A flexible tube, not shown, is preferably used to connect the output duct 34 to the duct 36 for distribution. In the lower portion 48 of the refrigeration unit 32 is a compressor 56 and condenser coils 58 of conventional design which are connected to the evaporator coils 52 through tubing passing through the plate 50. An ambient air inlet 60 is provided to allow air into the refrigeration unit 32 flowing over the condenser coils 58.

Figure 5:
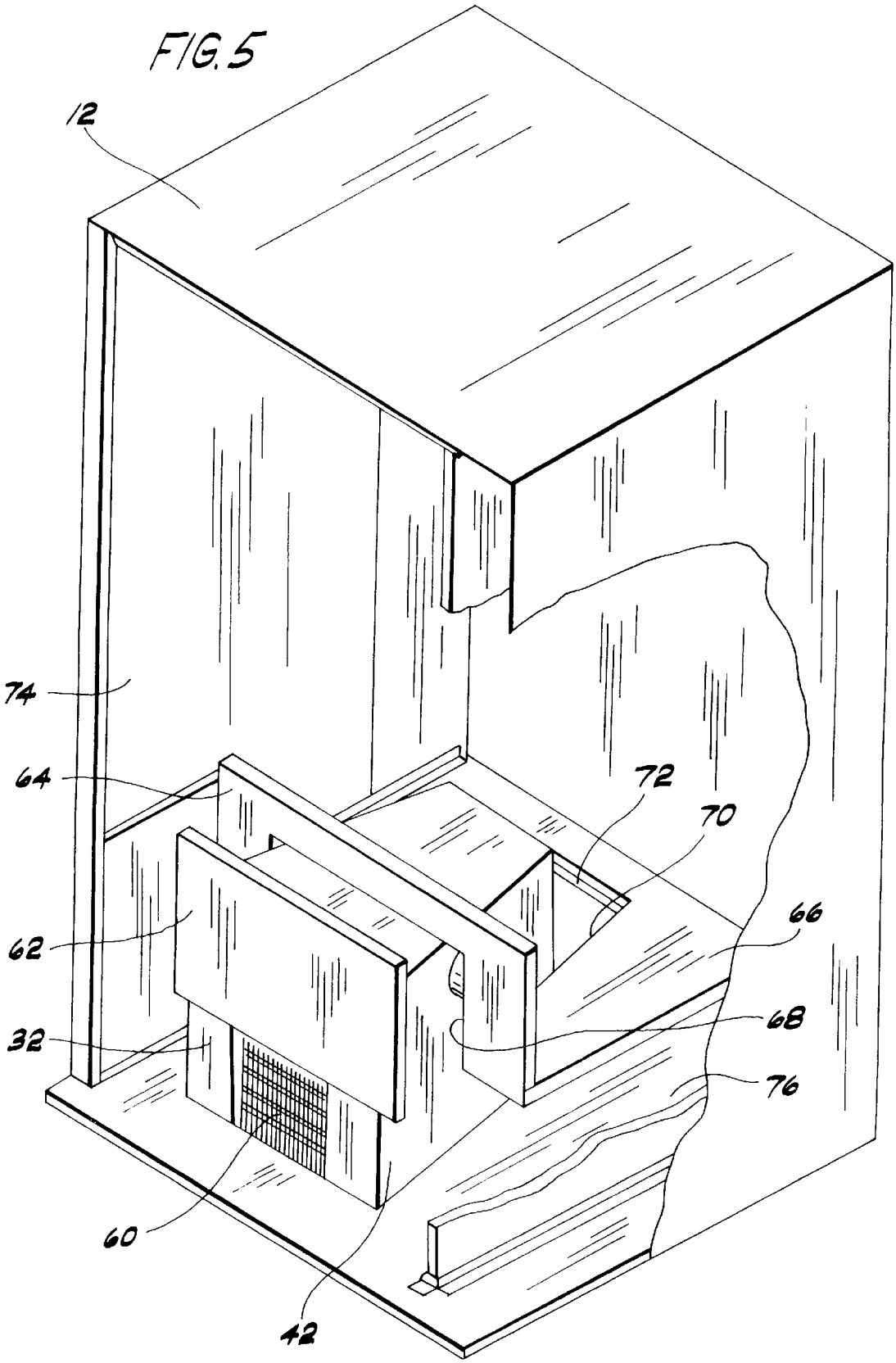
FIG. 5 is a perspective view partially cutaway and with some components removed of the preferred embodiment showing the refrigeration unit partially installed in the bottom of the cabinet.
Figure 6:
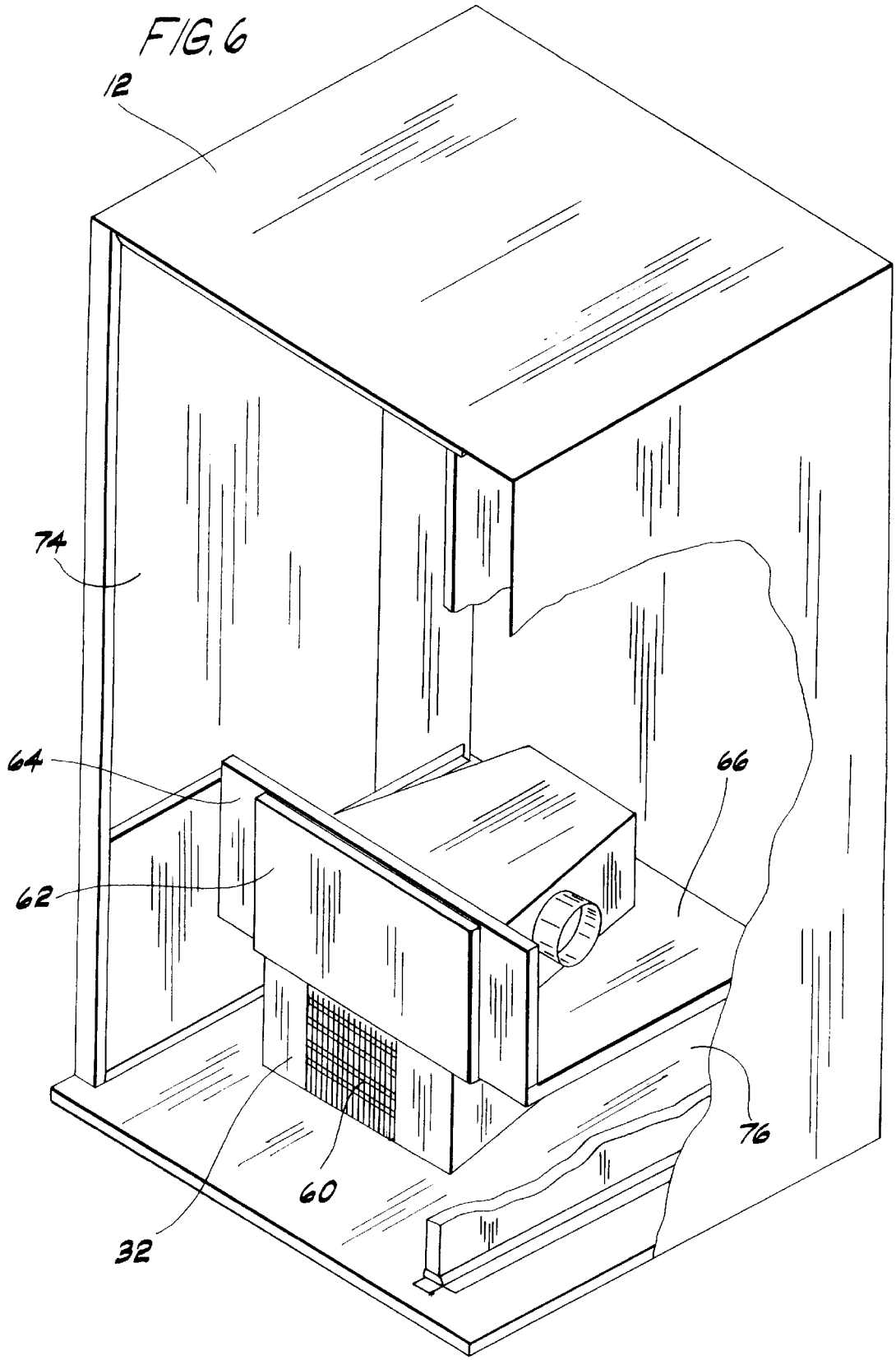
FIG. 6 is a view similar to that of FIG. 5 with the refrigeration unit fully installed in the bottom of the cabinet.

As seen in FIGS. 5 and 6, an insulated panel 62 is mounted to the front vertical wall 42 of refrigeration unit 32 to engage the front face of stationary insulation panel 64 mounted in the cabinet 12. A horizontal stationary insulated panel 66 is also mounted to the inside of cabinet 12. An inverted U-shaped opening 68 is formed in vertical panel 64 for receiving the refrigeration unit 32 therethrough such that the insulated panel 62 butts up against it in sealing engagement therewith. Additional compressible sealing members (not shown) may be used between the panels 62 and 64 to assist in sealing if desired. A similar opening for receiving the refrigeration unit 32 is defined in the horizontal panel 66 with converging side walls 70, one being shown, and a rear wall 72 joining the side walls 70. The surfaces of side walls 70 are preferably vertical and are provided with compressible sealing members which engage the vertical side and back walls of the refrigeration unit 32 as it is slid into engagement with them. Thus, the refrigeration unit 32, and panels 62 and 66 with their respective receiving openings are so proportioned and arranged such that as the refrigeration unit 32 is slid on the bottom of the cabinet 12 into engagement with the panels 62 and 66 they simultaneously seal against each other to provide a thermal barrier between an upper completely insulated portion 74 and a lower portion 76 of cabinet 12. The duct 34 in vertical side wall 42 and the return air opening 44 in the opposite vertical side wall of the refrigeration unit 34 are both in the insulated upper portion 74 of cabinet 12 so that the cold air circulation path stays within the insulated portion of the machine to reduce inefficiencies in heat transfer.

In addition to the refrigeration cycle equipment in the refrigeration unit 32 there is contained therein a heating coil 77 mounted adjacent the evaporator coils 52 to provide heated air to the duct 34 and thus to the insulated portion of the cabinet 12 if necessary. Since this machine 10 is designed to be used outdoors, it may be necessary in some colder locations or seasons to provide heat to preserve the product instead of refrigeration. Once the refrigeration unit is placed in position for operation, its power and control circuits are connected and the input duct 34 is connected to the duct 36 to provide temperature controlled air to the insulated portion of the cabinet 12. The control circuit for the refrigeration unit 32 includes a thermistor 80, as seen in FIG. 2, or similar temperature sensor, preferably positioned at the lower front portion of the insulated upper portion 74 of the cabinet 12 adjacent the lower shelves of product. By positioning the sensor 80 at this approximate location, it will sense the warmest temperatures (where refrigeration is necessary) since it is adjacent the lower portion of the glass 16 on the front door 14 where the sun will likely cause the greatest and more immediate heating inside the insulated portion 74 of the machine 10. Thus, by determining the temperature in this region which is adjacent the product in the front of the lower shelves 20 the temperature of these products which are most likely to be heated first can be kept at a desired temperature since there will be some variation in temperature from the front to the back of the machine due to differences in circulating air temperatures. The sensor 80 is connected to a microprocessor 82, as seen in FIG. 11, which is also connected to the refrigeration unit 32 and programmed to control it as desired.

Figure 7:
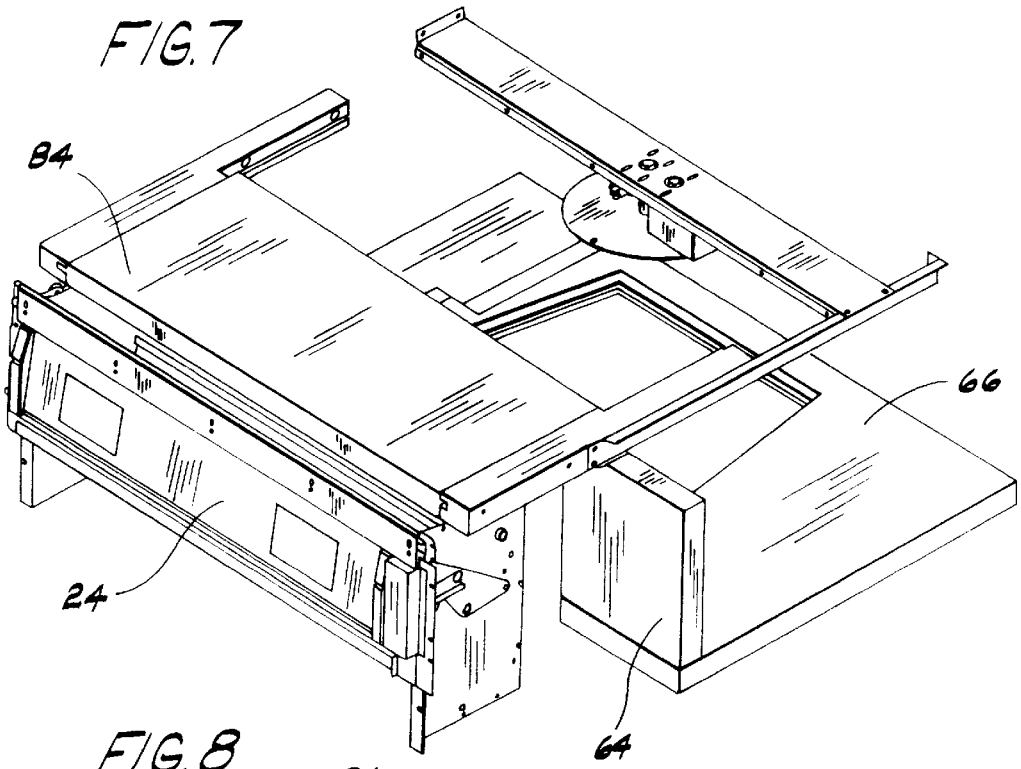
FIG. 7 is a perspective view of elements of the preferred embodiment showing the closed position of the insulated door covering the vend bucket.
Figure 8:
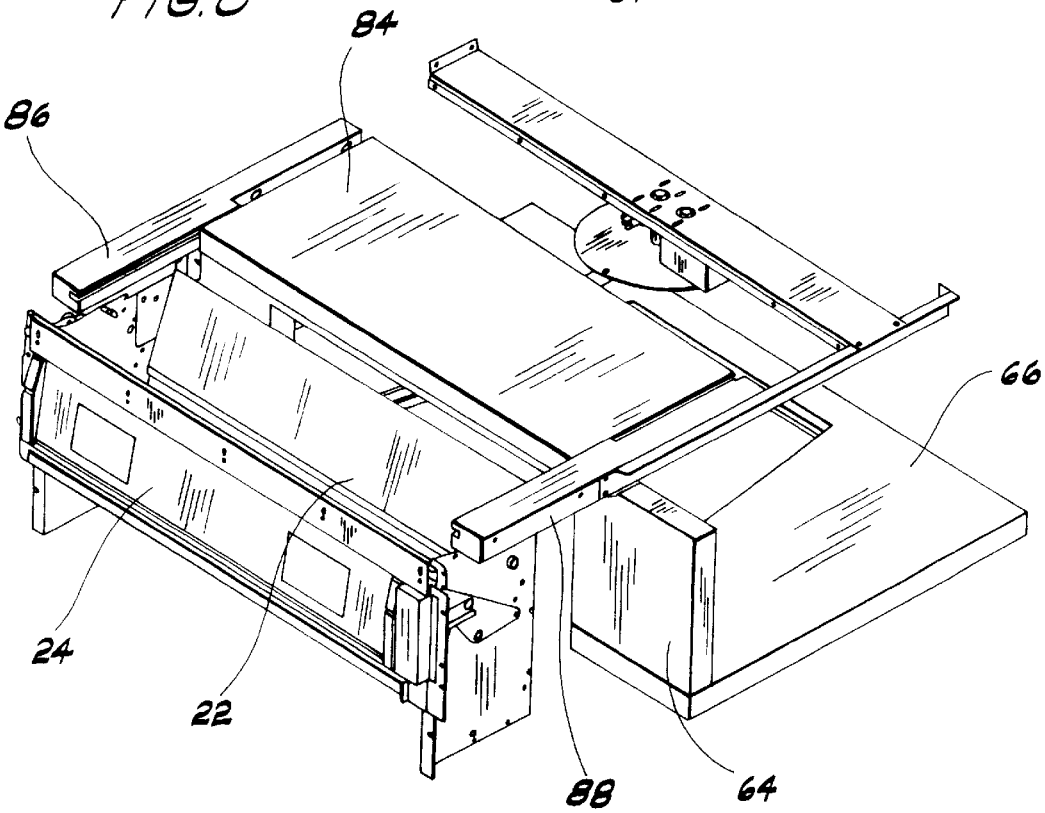
FIG. 8 is a perspective view similar to FIG. 7 with the insulated door in the open position for allowing vended products to enter the vend door.
Figure 9:
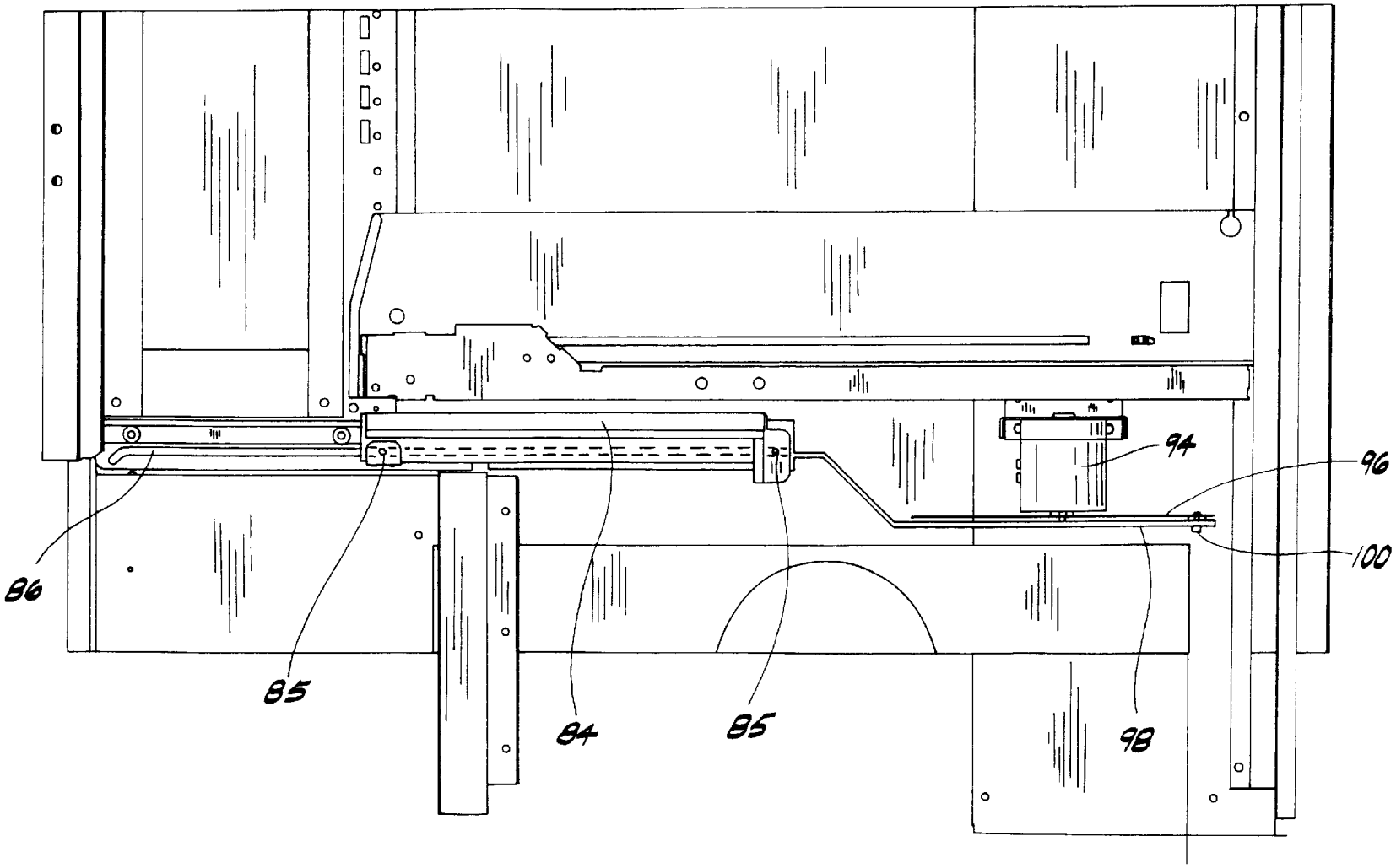
FIG. 9 is a partial side elevational view showing the insulated door in the open position as in FIG. 8.

Referring to FIGS. 2 and 7–9, to assist in sealing off the upper portion 74 of the interior of vending machine 10 it is necessary to provide an insulated door, such as door 84, to cover the vend bucket 22 to prevent continuous lose of cooled or heated air through the uninsulated vend bucket. However, door 84 must be movable to allow product to drop from the shelves 20 into the vend bucket 22 in the usual manner. To this end, door 84 is mounted for sliding movement with two sets of pins 85 secured thereto at the fore and aft portions of each side of door 84 for movement in tracks 86 and 88 on opposite sides of the vend bucket 22. Track 86 will be described with the understanding that track 88 is a mirror image thereof. Track 86 supports the door 84 for movement between a closed position, as shown in FIG. 7 wherein the door 84 is resting upon the upper edges of the vend bucket and engaging the inner back surface of the outer door 14 to seal the area of the vend bucket, and an open position, as shown in FIG. 8, wherein the door 84 is in a remote position such that the top of the vend bucket 22 is open to receive product dispensed from the shelves 20. To achieve this movement of door 84, tracks 86 and 88 are provided at their forward ends 90 with a downward turned portion which causes the forward pin 85 and the forward edge of door 84 to move downwardly and a similar downward turned track 92 in the middle of tracks 86 and 88 which causes the rear pin 85 and the back edge of the door 84 to move downwardly simultaneously with the front end of the door which causes the door 84 to come down on the top of vend bucket 22. The back and forth movement of door 84 is produced by rotation of motor 94 which carries a rotary crank comprised of disk 96 mounted to the drive shaft of the motor 94 and a drive arm 98 rotatably connected by a bolt 100 to disk 96 at one end and at its other end it is pinned to the rear of door 84 with a sufficiently loose connection to allow enough vertical movement of door 84 to move vertically to come up and down on top of the vend bucket as described above. Rotation of motor 94 is controlled by the microprocessor 82 so that when a customer makes a purchase of an item on one of the shelves 20 the door 84 is moved from its closed position to its opened position to allow the selected item to fall off the shelf into the vend bucket and then returned to its closed position.

Figure 10:
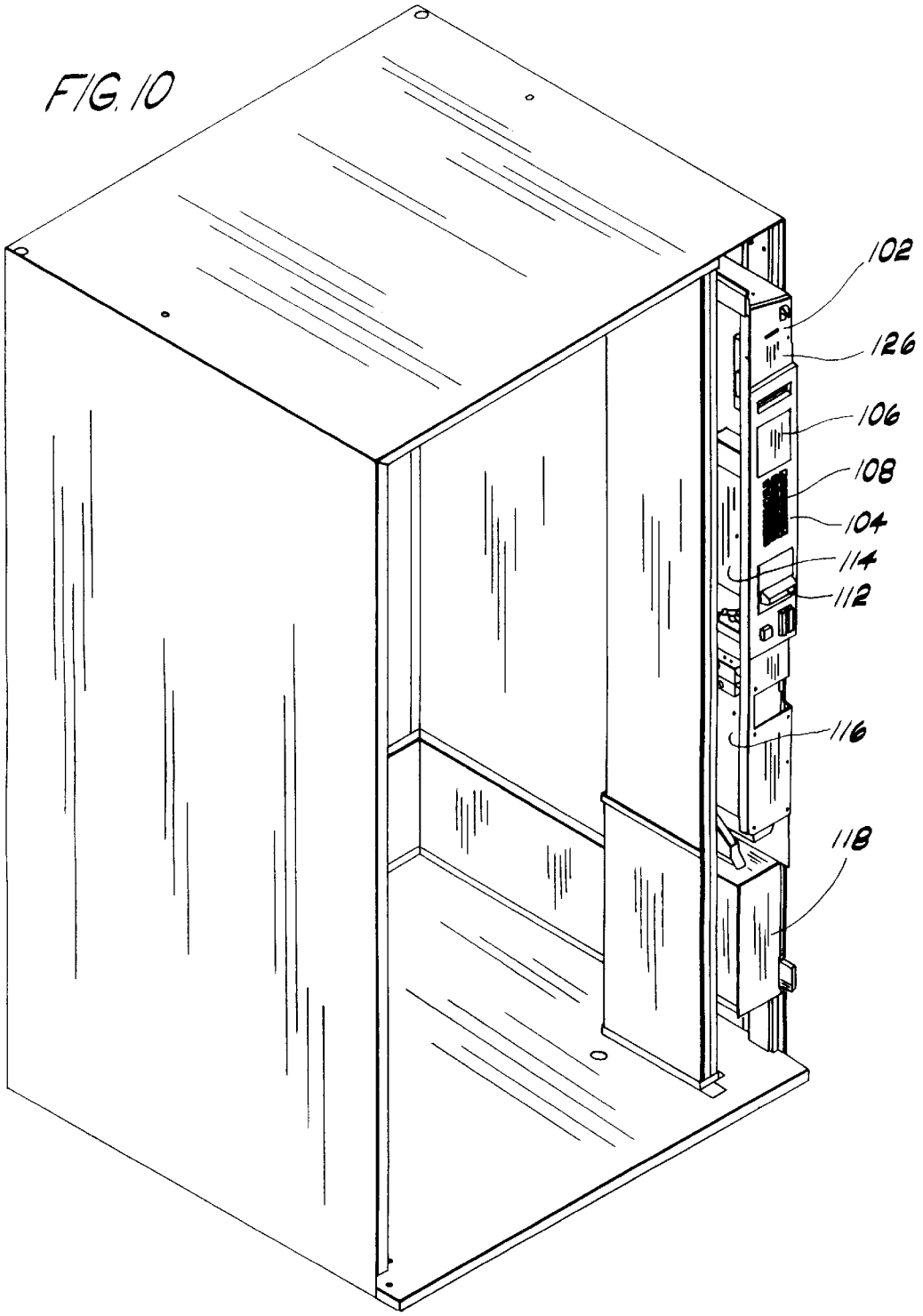
FIG. 10 is a perspective view of the cabinet and monetary portions of the preferred embodiment.
Figure 11:
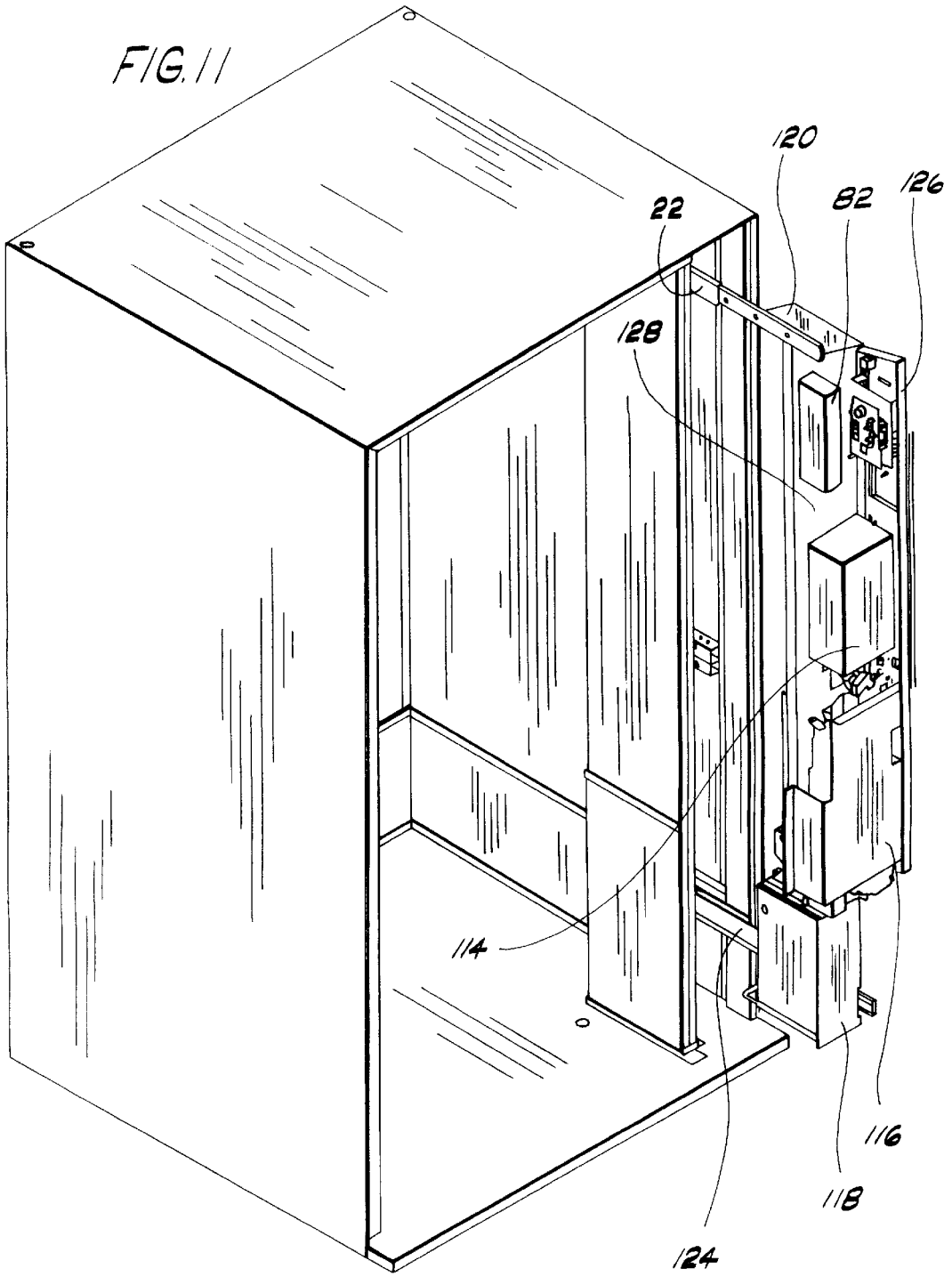
FIG. 11 is a perspective view similar to FIG. 10 with the monetary section pulled out of the cabinet and rotated.

Referring to FIGS. 10 and 11, the monetary section, shown generally as 102, of vending machine 10 includes a customer interactive area 104 which includes a message screen 106 and a key board 108. As is well known in the art this section is also used by the serviceman to program the microprocessor 110 to control operation of the machine 10. The monetary section also contains a conventional bill validator 112 and paper currency storage area 114, a conventional coin mechanism 116 for accepting coins from a customer and giving change, and coin storage box 118. For ease of access all of the monetary section 102 is mounted to a slide-out frame 120 mounted on telescoping tracks 122 and 124 at the upper and lower portions of frame 120. A front plate 126, to which all of the monetary section except the coin storage box 118 are mounted, is mounted at its top and bottom for pivotal movement to a fixed panel 128 which is mounted directly to tracks 122 and 124. When in the storage position, as shown in FIG. 10, the monetary unit sets adjacent panel 128 which prevents vandals from attempting to pry open the front door 14 and access the bill validator 112 and currency storage area 114. When pulled out and rotated, as shown in FIG. 11 the monetary section is easily accessible for servicing and is easier to assemble when the machine is initially constructed.

In view of the above, it will be seen that the several objects of the invention are achieved and other advantageous results attained.

As various changes could be made in the above product and methods without departing from the scope of the invention, it is intended that all matter contained in the above description and shown in the accompanying drawings shall be interpreted as illustrative and not in a limiting sense.

What is claimed is:

1. A vending machine, comprising:

a housing having a floor and forming an interior space with an open front;

a door attached to the housing for pivotal movement between an open position for allowing access to the interior space of the housing through the open front and a closed position for covering the open front;

a horizontal shelf in the housing dividing the interior space of the housing into upper and lower portions, the shelf defining an opening along an edge thereof extending towards the open front of the housing; and a refrigeration unit having substantially vertical side portions engageable with the edge of the shelf defining the opening therein, the refrigeration unit being slidable on the floor of the housing into the housing with the front door in the open position such that the vertical side portions engage the edge of the shelf along substantially the length of the opening therein.

2. The vending machine of claim 1 wherein the edge of the shelf defining the opening has tapered converging sides and the sides of the refrigeration unit are similarly tapered.

3. The vending unit of claim 2 including the refrigeration unit having an evaporator and fan located in the upper portion of the housing and a compressor and condenser located in the lower portion of the housing when the unit is engaged with the shelf.

4. The vending machine of claim 3 further including a heating member in the refrigeration unit disposed in the upper portion of the housing when the unit is engaged with the shelf.

5. The vending machine of claim 1 wherein the shelf and upper portion of the housing are insulated.

6. The vending machine of claim 3 wherein the edge of the shelf defining the opening is provided with a seal engageable with the side portions of the refrigeration unit.

7. The vending machine of claim 1 including:

an output duct in the refrigeration unit adjacent the fan;

a circulation duct along an inside wall of the housing connectable with the output duct for receiving cold air therefrom and circulating it through the housing; and a return air passage formed in the refrigeration unit adjacent the evaporator for returning air circulated through the housing to the evaporator to be cooled.

8. A method of removably sealing a refrigeration unit in a vending machine having an interior space accessible through an open front covered by a door, comprising the steps of:

providing a horizontal shelf with a contoured edge facing the open front in the interior space of the vending machine so as to divide the interior space into upper and lower portions;

providing a refrigeration unit with vertical side walls engageable with the contoured edge of the horizontal shelf; and sliding the refrigeration unit into the interior space of the vending machine so that the vertical side walls of the refrigeration unit engage the contoured edge of the shelf.

9. The method of claim 8 including the steps of:

providing the contoured edge with converging side walls and providing the side walls of the refrigeration unit to matingly engage the converging side walls of the contoured edge of the shelf when the unit is slid into the housing.

10. A vending Machine, including:

a housing forming an insulated interior portion and a glass front door;

a plurality of product support shelves contained in the interior portion of the housing;

a temperature sensing probe disposed on the interior portion adjacent a front portion of one of the shelves and the glass in the door;

a combined refrigeration and heating unit disposed in the housing; and a controller associated with the unit and the temperature sensing probe so as to receive temperature information from the probe and operate the unit to either heat or cool the interior portion of the housing.

11. A vending machine as defined in claim 10 wherein the temperature sensing probe is a thermistor.

12. A vending machine as defined in claim 10 wherein the temperature probe is disposed in the lower front portion of the machine.

13. A vending machine as defined in claim 12 wherein the temperature probe is disposed between the front portion of the shelf and the glass.

* * * * *